United States Patent [19]

Klomp

[11] 4,385,694

[45] May 31, 1983

[54] PACKAGED ELECTRIC LAMP

[75] Inventor: Franciscus M. Klomp, Eindhoven, Netherlands

[73] Assignee: U.S. Philips Corporation, New York, N.Y.

[21] Appl. No.: 259,800

[22] Filed: May 4, 1981

[30] Foreign Application Priority Data

Jun. 2, 1980 [NL] Netherlands ..... 8003196

[51] Int. Cl.[3] ..... B65D 85/42

[52] U.S. Cl. ..... 206/418; 206/419; 229/39 B

[58] Field of Search ..... 206/418, 419, 420, 421, 206/422; 229/52 BC, 39 B

[56] References Cited

U.S. PATENT DOCUMENTS 4,194,623 3/1980 Klomp et al. ..... 206/418

FOREIGN PATENT DOCUMENTS 127911 12/1931 Austria ..... 229/39 B
468350 9/1950 Canada ..... 206/422
1464056 11/1966 France ..... 206/418
702024 1/1954 United Kingdom ..... 206/418

*Primary Examiner*—William Price
*Assistant Examiner*—Brenda J. Ehrhardt
*Attorney, Agent, or Firm*—Thomas A. Briody; William J. Streeter; Rolf E. Schneider

[57] ABSTRACT

There is provided an electric lamp package comprising a lamp envelope formed with a convex portion and having a packaging strip extending therearound with its ends engaging each other substantially flatly beyond the lamp cap. One long side of the packaging strip is formed with a pair of lengthwise incisions to form a central portion in contact with the convex portion of the lamp envelope and a pair of edge portions extending along the central portion and being in opposite lateral contact with the lamp envelope. The lamp is arranged asymmetrically with respect to such two edge portions with the lamp cap positioned between the central portion and the flatly engaged ends of the packaging strip. A lengthwise extending opening is formed in the other long side for displaying part of the lamp, with a pair of adjoining edge portions. At least part of the opening boundary is in contact with the lamp envelope to keep the lamp fixed in place. The corresponding edge portions of the oppositely disposed long sides are secured together.

3 Claims, 7 Drawing Figures

PACKAGED ELECTRIC LAMP

This invention relates to a package electric lamp whose lamp envelope has a neck-shaped portion which adjoins a convex lamp envelope portion at one end with a lamp base or cap connected at the other end, the package consisting of an elongate strip of packaging material extending along the lamp cap and curved around the convex lamp envelope portion to form two strip portions which extend beyond the lamp cap, each strip portion having lengthwise incisions, each incision in one of the two strip portions beginning between the neck-shaped portion of the lamp envelope and the largest cross-section of the convex lamp envelope portion and continuing to beyond the lamp cap but not to the relevant end of the strip portion, each such incision together with the nearest adjacent edge of the strip portion defining an edge strip, the edge strips in such one strip portion being locally secured to the other strip portion.

Such a packaged electric lamp is known from U.S. Pat. No. 4,194,623. An attractive aspect of the known product is that only a small amount of constructional material is required for the package as compared with boxes and sheets. Furthermore, the strip of packaging material with incisions can be used directly to package the lamp. In contrast with boxes the blank need not be initially prepared by a folding and securing operation, before the lamp can be packaged therein. In fact, the package is obtained from the blank by curving it in the form of a U-shape around the lamp envelope and connecting together the limbs of the U-shape on either side of the lamp. It is sufficient when this is done in only two places.

In the known product the shape and the nature of the lamp envelope, as well as the shape and the size of the lamp cap of the packaged lamp are clearly visible from the sides. Visibility of the lamp is of great importance for the purchaser because it allows him to find the correct lamp much more easily than when he must rely only on printed information about the contents of the package. However, if the known package can be inspected only from the front, which is the case, for example, when several packaged lamps are suspended beside each other, the lamp itself in the known product is hardly visible.

It is the object of the present invention to provide a packaged electric lamp which provides a considerably improved visibility of the lamp while maintaining the good properties of the known product: i.e. only a small amount of constructional material, simple manufacture and a small number of connections to be made.

According to the invention, this object is achieved in that the lengthwise incisions in the other strip portions are joined by transverse incisions to form an opening or window through which the lamp is partly visible and the boundary of which keeps the lamp fixed in the package.

Packaged electric lamps according to the invention can be accommodated so that the purchaser can establish at a glance the type of lamp. This is the case in spite of the fact that the window is smaller than the silhouette of the lamp as the other strip portion with the boundary of the window has to contribute to the fixing of the lamp in the package.

The packaged lamp according to the invention differs essentially from the known product. This is not only due to the presence of the window but also—as a result thereof—to the asymmetric arrangement of the lamp in the package. This will become apparent from the drawings.

There are ample possibilities to vary the shape and the size of the window. In lamps for general illumination purposes it will usually be sufficient to know the finish of the lamp envelope: i.e. whether the lamp envelope is frosted, transparent, or provided with a light scattering coating. In this case a window will suffice which exposes only a small part of the lamp envelope. In lamps which radiate a directed light beam it is of importance that the means used for that purpose can be observed: for example, in a bowl-mirrored lamp the mirror; in a window lamp the usually frosted window of the lamp envelope which is otherwise coated. In those cases the window in the package may extend a larger distance from the lamp cap of the lamp, for example to beyond the place where the lamp envelope has its largest cross section.

The window in the package may furthermore be designed so as to show at least a part of the lamp cap, for example the whole length or at least locally the whole width. However, it is possible for the window to show the contours of the lamp cap entirely. In that case the window is smaller at the area of the neck-shaped portion of the lamp envelope so as to prevent the lamp cap from passing outwards through the window.

If it should be desirable to show the contours of the lamp cap entirely and also to make a major part of the lamp envelope visible, a second window may be provided in the other strip portion in the longitudinal direction of the strip at a distance from the first window.

On the other hand, in certain circumstances in which no misunderstanding can occur as to the nature and the size of the lamp cap, the window may be positioned entirely at the area of the lamp envelope.

As a rule it is to be preferred for the window to exhibit both a part of the lamp envelope and the greater part of the lamp cap. An equally informative packaging strip comprises a window at the area of the lamp cap and a second window at the area of the lamp envelope.

In a particular embodiment of the packaged lamp according to the invention, two or more strips of packaging material are united along their respective sides and a corresponding number of lamps is packaged therewith.

The two portions of the strip of packaging material, for example, duplex paper board, triplex paper board and so on, are usually connected together at the side of the lamp cap, for example by stapling or glueing. The connection places may be situated alongside the edge of the lamp cap where it engages the lamp envelope, or in the immediate proximity thereof, although the connection can also be realized more in the direction of the convex lamp envelope portion. Although it will do no harm to produce connections in several places, a total of two connections situated one on either side of the lamp is usually adequate.

The products according to the invention are suitable for presentation in a suspended position. In fact, the two portions of the strip, insofar as they extend to beyond the lamp cap, engage each other sustantially flatly. At that area an aperture, for example a slot-like aperture, may be punched in the strips so that the products can be used as "pin packs".

In another embodiment of a packaged lamp according to the invention, a lug is punched out of each of the two strip portions, which lugs extend in the longitudinal direction of the lamp to beyond the lamp envelope. The lugs enable the packaged lamps to be presented also in a standing position with the lamp cap uppermost. A second function of the lugs, however, is that of a shock absorber, which makes the packaged lamps even more resistant to impact. For optimum stability of the standing product the lugs are preferably cut out in such manner as to have a large mutual distance. On the other hand it is not desirable to move the connection point of the lugs towards the lamp cap over such a distance that the lugs obtain a large length and hence become weaker. Usually, the connection point of the lugs will be situated remote from the lamp cap with the largest cross-section of the lamp envelope in between. When the strip is curved around the lamp envelope, the lugs automatically assume a correct position and give a great stability to the packaged lamp when in the free-standing condition.

The package is particularly suitable for use with electric incandescent lamps, in particular incandescent lamps for general illumination purposes, silver-cupped lamps, reflector lamps and the like, and also for gas discharge lamps. The convex lamp envelope portion may have a variety of shapes, from spherical to conical.

It is to be noted that an electric lamp packaged also in a strip is known from British Pat. No. 702,024. In that known product, however, the visibility of the lamp is less good than in the product described in the above-mentioned United States patent.

The invention will now be described in detail with reference to the accompanying drawings, in which.

Figure 1:
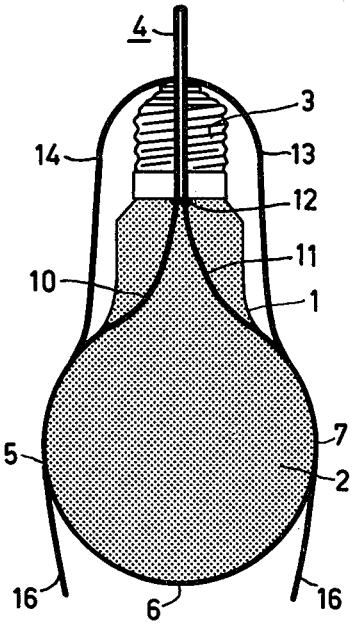
FIG. 1 PRIOR ART
FIG. 1 is a side elevation of a packaged lamp as described in the above-mentioned United States patent.
Figure 2:
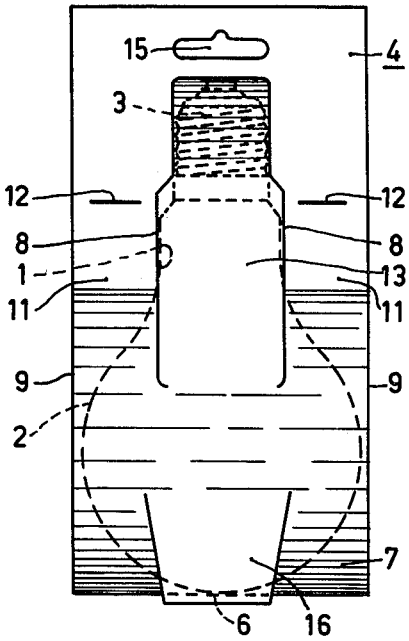
FIG. 2 PRIOR ART
FIG. 2 is a front elevation of the same package.

The packaged lamp shown in FIGS. 1 and 2 has a neck-shaped lamp envelope portion 1 which at one end adjoins a convex lamp envelope portion 2 and to which a lamp base or cap 3 is connected at the other end. An elongate strip 4 of duplex paper board (weight from 230 to 400 g/m$^2$) extends along the lamp cap 3, is formed in a curve 6 around the convex lamp envelope portion 2 and returns to beyond the lamp cap 3. In each of the two identical strip portions 5 and 7 formed by the curve 6, the strip 4 has incisions 8 mainly extending in the longitudinal direction of the strip 4, along the lamp envelope 1, 2 and the lamp cap 3, which incisions, with the respective near edge 9 of the strip 4, bound edge strips 10 in strip portion 5 and edge strips 11 in strip portion 7. Opposite edge strips 10 and 11 are locally connected together by staples 12.

The central strip portions 13 and 14 formed by the incisions 8 prevent the tilting of the lamp in the plane of the drawing of FIG. 1. The edge strips 10 and 11 which are connected together extend radially with respect to the lamp cap 3 and prevent tilting of the lamp in the plane of the drawing of FIG. 2.

In FIG. 1 the lamp is clearly visible so that both its lamp cap 3 and its lamp envelope 1, 2 can be seen but when the packaged lamp is suspended from a pin in the wall by means of the aperture 15, the lamp (in the FIG. 2 position) is entirely invisible.

Punched lugs 16 on the one hand permit of presenting the packaged lamp in a standing position, and on the other hand form shock absorbers.

Figure 3:
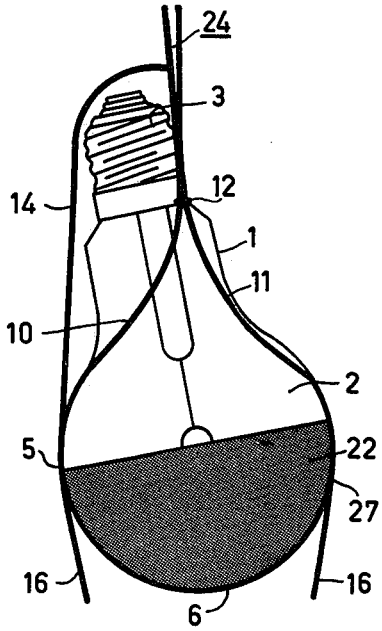
FIG. 3 is a side elevation of a packaged lamp according to the invention.
Figure 4:
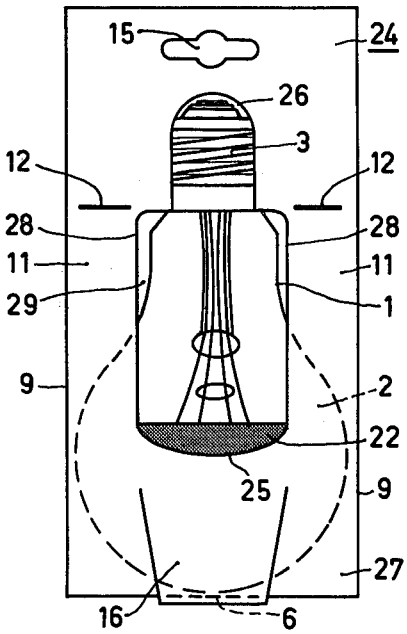
FIG. 4 is a front elevation of the packaged lamp shown in FIG. 3.

In FIGS. 3 and 4 a part of the lamp envelope has a mirror portion 22. A strip 24 of packaging material extends along the lamp cap 3, is curved around the convex lamp envelope portion 2 at the curve 6 and extends back to beyond the lamp cap 3. The strip portion 5 of the strip 24 formed by the bending operation has two edge strips 10 of which one is visible and a central strip portion 14, and is substantially the same as the strip portions 5 and 7 of FIGS. 1 and 2.

Edge strips 11 bounded by incisions 28 are formed in the other strip portion 27. The edge strips 10 are connected to the other strip portion 27 by means of staples 12 at the area of the edge strips 11.

The incisions 28 extend in the other strip portion 27 along the lamp envelope 1, 2 and the lamp cap 3 and substantially in the longitudinal direction of the strip 24.

The incisions 28 are interconnected by incisions 25 and 26, as a result of which an opening or window 29 is formed through which the lamp envelope 1, 2 with the mirror portion 22 and the lamp cap 3 are partly visible.

It may be seen from FIG. 3 that the lamp is incorporated asymmetrically in the strip 24. The sides of the window 29, as defined by the incisions 28 which in the region of the lamp cap 3 are closer together than the diameter of the lamp cap 3, together with the central strip 14 of strip portion 5, prevent the lamp from tilting in the plane of the drawing of FIG. 3. The edge strips 10 at the arc of the neck-shaped envelope portion 1 ensure that the lamp does not tilt in the plane of the drawing of FIG. 4. As shown in FIG. 3, the edge strips 10, 11 do not bear radially against the lamp cap 3 as in FIG. 1, but rather tangentially.

Viewed from the side (FIG. 3) as well as viewed from the front, the packaged lamp standing on the lugs 16 or suspended from the aperture 15 (FIG. 4), insofar as its features which distinguish it from other types of lamps are concerned, can be readily inspected.

Figure 5:
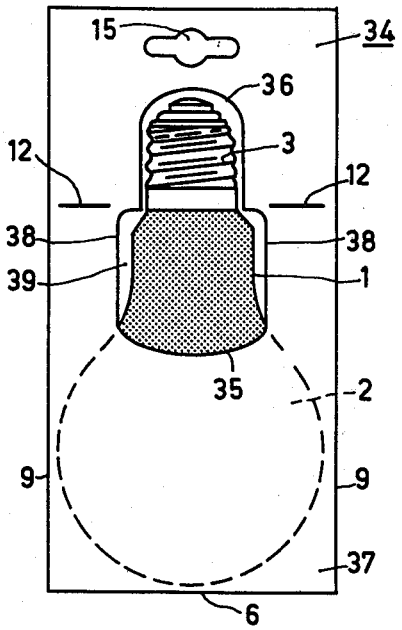
FIG. 5 is a front elevation of another embodiment in accordance with the invention.

In FIG. 5, the other strip portion 37 has incisions 38 which extend in the longitudinal direction of the strip 34 but are shorter than those of FIG. 4. They are joined by incisions 35 and 36 as a result of which a window 39 is formed. The strip portion of strip 34 does not differ from strip portion 5 in FIG. 3. In this packaged lamp the boundary of the window 39 (incision 35) fixes the lamp 1, 2, 3 in the package 34 and prevents the lamp from tilting forward. The lamp 1, 2 is frosted. Since frosting of the neck-shaped lamp envelope portion 1 is used only in fully frosted lamp envelopes the aspect of the neck-shaped portion 1 and the lamp cap 3 in this lamp give full information on the nature of the lamp, not counting operating voltage and power.

Figure 6:
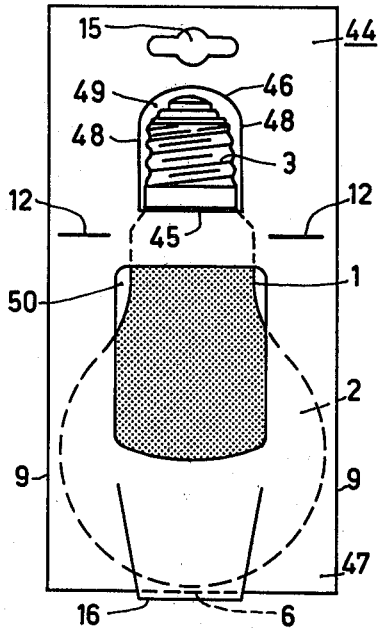
FIG. 6 is a front elevation of still another embodiment in accordance with the invention.

In FIG. 6, the other strip portion 47 has incisions 48 which extend in the longitudinal direction of the strip 44 but are present only at the area of the lamp cap 3. The incisions 48 are connected by incisions 45 and 46 so that a window 49 is formed through which only the contours of the lamp cap 3 are visible.

The boundary of the window 49 formed by the incision 45 fulfils an important function in fixing the lamp 1, 2, 3 in the strip 44 in that it prevents the lamp from tilting forward.

Viewed in the longitudinal direction of the strip 44 at a distance from the window 49 a second window 50 is present which makes it possible to see a considerable part of the lamp envelope 1, 2.

The strip portion of the strip 44 is formed like the strip portion 5 in FIG. 3.

Figure 7:
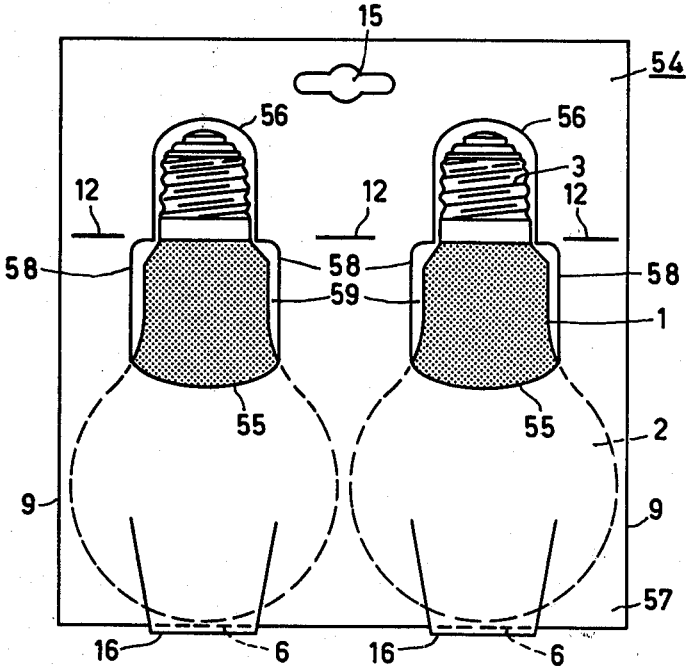
FIG. 7 is a front elevation of a twin pack according to the invention.

In FIG. 7 the strip 54 is substantially double the width of the strips in the preceding Figures and it is suitable for packaging two lamps. Windows 59 in the other strip portion 57 each correspond substantially with the window 39 in FIG. 5. They are each formed by two incisions 58 which extend substantially in the longitudinal direction of the strip 54 and respective incisions 55 and 56 which connect the ends of the two incisions 58.

The strip portion of strip 54 corresponds substantially to the strip portion 5 in FIG. 3 doubled in a comparable manner.

I claim:

1. An electric lamp package, which comprises a lamp envelope having a neck adjoining at one end a convex portion and connected at the other end to a lamp cap; an elongate packaging strip extending at one end from beyond the lamp cap and bent around the convex portion of the lamp envelope and extending at its other end back beyond the lamp cap to form two oppositely disposed long sides, said two extending ends engaging each other substantially flatly; a pair of lengthwise incisions in one long side to provide a packaging strip central portion in contact with the abutting convex portion of the lamp envelope and two packaging strip edge portions extending along said central portion and being in opposite lateral edge-wise contact with the lamp envelope, the central portion extending from the bottom of the lamp cap to an area on the lamp envelope convex portion between the lamp envelope neck and the greatest cross section of said convex portion, said lamp being arranged asymmetrically with respect to said two edge portions with the lamp cap positioned between said central portion and said flatly engaged extending ends; a lengthwise extending opening formed in the other long side to provide a window for displaying part of the lamp, with two packaging strip edge portions adjoining said opening, at least part of the boundary of said opening being in contact with the lamp envelope to keep the lamp fixed in place; and means to secure together the corresponding edge portions of the two oppositely disposed long sides.

2. An electric lamp package according to claim 1, in which the opening is such that it displays a part of the lamp envelope and a part of the lamp cap.

3. An electric lamp package according to claim 1, in which the opening is such that it displays a part of the lamp envelope and the other long side includes a separate, second opening providing a second window for displaying a part of the lamp cap.

* * * * *